US007805926B2

(12) United States Patent
Abi-Akar et al.

(10) Patent No.: US 7,805,926 B2
(45) Date of Patent: Oct. 5, 2010

(54) EXHAUST TREATMENT SYSTEM HAVING AN ACIDIC DEBRIS FILTER

(75) Inventors: Hind M. Abi-Akar, Peoria, IL (US); Dennis Lee Endicott, Hanna City, IL (US); James R. Weber, Lacon, IL (US); Erin Elizabeth Atterberry, Washington, IL (US)

(73) Assignee: Caterpillar Inc, Peoria, IL (US)

( * ) Notice: Subject to any disclaimer, the term of this patent is extended or adjusted under 35 U.S.C. 154(b) by 695 days.

(21) Appl. No.: 11/797,026

(22) Filed: Apr. 30, 2007

(65) Prior Publication Data

US 2008/0264038 A1 Oct. 30, 2008

(51) Int. Cl.

| | |
|---|---|
| ***F02M 25/06*** | (2006.01) |
| ***F01N 3/00*** | (2006.01) |
| ***F01N 3/02*** | (2006.01) |
| ***B01D 59/26*** | (2006.01) |
| ***F02B 47/08*** | (2006.01) |

(52) U.S. Cl. ..... 60/278; 60/297; 60/311; 96/108; 123/568.11; 123/568.12

(58) Field of Classification Search ..... 60/278, 60/297, 311, 273; 96/108; 123/568.11, 568.12
See application file for complete search history.

(56) References Cited

U.S. PATENT DOCUMENTS

| | | | | |
|---|---|---|---|---|
| 5,135,551 | A | 8/1992 | Fielding | |
| 5,458,664 | A | 10/1995 | Ishii et al. | |
| 5,809,777 | A | 9/1998 | Kawamura | |
| 6,301,887 | B1 | 10/2001 | Gorel et al. | |
| 6,742,335 | B2 | 6/2004 | Beck et al. | |
| 6,851,414 | B2 * | 2/2005 | Gao et al. | 123/568.12 |
| 6,948,475 | B1 | 9/2005 | Wong et al. | |
| 6,981,375 | B2 | 1/2006 | Sisken et al. | |
| 7,159,393 | B2 | 1/2007 | Blomquist et al. | |
| 2005/0115222 | A1 * | 6/2005 | Blomquist et al. | 60/274 |
| 2005/0153250 | A1 * | 7/2005 | Taylor et al. | 431/1 |
| 2006/0042237 | A1 | 3/2006 | Nonoyama et al. | |
| 2007/0297961 | A1 * | 12/2007 | Silver et al. | 423/212 |
| 2008/0104947 | A1 * | 5/2008 | Wang et al. | 60/295 |

FOREIGN PATENT DOCUMENTS

| | | |
|---|---|---|
| JP | 2003-097361 | 4/2003 |
| WO | 98/27323 | 6/1998 |
| WO | 03/067044 | 8/2003 |
| WO | 2004/011784 | 2/2004 |

OTHER PUBLICATIONS

"Activated Carbon (Honeycomb Activated Carbon)", Beihai Kaite Chemical Packing Co., Ltd., pp. 2-3.*
"Activated Carbon Fiber", BerlinKauf, pp. 2-3.*

* cited by examiner

*Primary Examiner*—Thomas E Denion
*Assistant Examiner*—Audrey Klasterka
(74) *Attorney, Agent, or Firm*—Finnegan, Henderson, Farabow, Garrett & Dunner LLC

(57) ABSTRACT

An exhaust treatment system for a power source has an air induction system, an exhaust system and a recirculation system. The exhaust system includes a particulate filter. The recirculation system is configured to draw exhaust from downstream of the particulate filter and direct the exhaust to the air induction system. The recirculation system includes an exhaust gas cooler, and an acidic debris filter.

18 Claims, 1 Drawing Sheet

EXHAUST TREATMENT SYSTEM HAVING AN ACIDIC DEBRIS FILTER

TECHNICAL FIELD

The present disclosure relates generally to an exhaust treatment system and, more particularly, to an exhaust treatment system having an acidic debris filter.

BACKGROUND

Internal combustion engines, including diesel engines, gasoline engines, natural gas engines, and other engines known in the art exhaust a complex mixture of air pollutants. The air pollutants may be composed of gaseous compounds, which may include nitrogen oxides (NOx), and solid particulate matter, also known as soot. Due to increased attention on the environment, exhaust emission standards have become more stringent, and the amount of gaseous compounds emitted to the atmosphere from an engine may be regulated depending on the type of engine, size of engine, and/or class of engine.

One method that has been implemented by engine manufacturers to comply with the regulation of engine emissions is exhaust gas recirculation (EGR). EGR systems recirculate the exhaust gas byproducts into the intake air supply of the internal combustion engine. The exhaust gas, which is directed to the engine's cylinders, reduces the concentration of oxygen within the cylinders, which in turn lowers the combustion temperature within the cylinder. The lowered combustion temperature can slow the chemical reaction of the combustion process and, thereby, decrease the formation of NOx.

In order to avoid damage to the engine, particulates and corrosives formed during the combustion cycle must be removed before exhaust gas is reintroduced to the engine. In many EGR applications, the exhaust gas is directed through a diesel particulate filter, or diesel particulate trap, before reintroduction into the engine's air system. However, the diesel particulate filter, over time, can become worn or damaged and allow particulates and corrosive substances to be recirculated into the engine, adversely affecting performance and durability of the internal combustion engine and components of the EGR system.

As disclosed in U.S. Pat. No. 7,159,393 (the '393 patent), issued to Blomquist on Mar. 3, 2003, a second particulate filter may be used to remove particulates that pass though a first filter. Specifically, the '393 patent discloses an exhaust gas regenerator and particulate capture system that includes a first particulate filter and a second particulate filter disposed in series. The first particulate filter is located downstream of an engine and upstream of an EGR system. The first filter is capable of catching particulates typical of the combustion process, so that exhaust gases are sufficiently filtered for recirculation back into the engine. The second filter may be located within the EGR system, downstream of a cooler and may have a filtering efficiency equal to or lower than that of the first filter. Under normal conditions the second filter will not contribute to the catching of particulate constituents of the circulated exhaust gas, therefore it remains unclogged. However, if the first filter is malfunctioning and allows unfiltered or insufficiently filtered exhaust gases to pass though, the second filter will contribute to reducing the content of particulate constituents of the recirculated exhaust gases.

Although the exhaust gas regenerator/particulate capture system of the '393 patent may protect the engine from harmful particulate matter, it may leave the engine unprotected from damage caused by harmful corrosives such as sulfuric acid that form within the EGR system, as a result of the particulate matter. For example, when exhaust gas passes through an ERG cooler, sulfuric acid may condense on the walls of the cooler and downstream passages, thus exposing downstream EGR and engine components to acidic attack. Sulfuric acid is particularly likely to form when a fuel other than ultra-low sulfur fuel is used. Consequently, when an operator fuels the engine with fuel having a higher sulfur content, costly damages may result. The filter of the '393 patent may do little to neutralize or remove the sulfuric acid from the exhaust flow and may, itself, be subject to sulfuric acid attack.

The disclosed exhaust treatment system is directed to overcoming one or more of the problems set forth above.

SUMMARY OF THE INVENTION

In one aspect, the present disclosure is directed to an exhaust treatment system for a power source. The exhaust treatment system includes an air induction system, an exhaust system and a recirculation system. The exhaust system includes a particulate filter. The recirculation system is configured to draw exhaust from the exhaust treatment system at a location downstream of the particulate filter and direct the exhaust to the air induction system. The recirculation system includes an exhaust gas cooler and an acidic debris filter located downstream of the exhaust gas cooler.

In another aspect, the present disclosure is directed to a power source that includes an engine, air induction system, an exhaust system and a recirculation system. The air induction system is configured to direct air into the engine. The exhaust system is configured to direct exhaust away from the engine and includes a particulate filter. The recirculation system is configured to draw exhaust from the exhaust system at a location downstream of the particulate filter and direct the exhaust into the air induction system. The recirculation system includes an exhaust gas cooler and an acidic debris filter located downstream of the exhaust gas cooler. The acidic debris filter includes an acid resistant filter media and a metallic cage that, when exposed to acid, reacts to neutralize the acid and form a solid precipitate.

In yet another aspect, the present disclosure is directed to a method of operating an exhaust treatment system. The method includes directing air into a power source and directing exhaust away from the power source. The method further includes reducing an amount of particulates in the exhaust, cooling a portion of the particulate reduced exhaust and removing acidic precipitate from the cooled particulate reduced exhaust.

DETAILED DESCRIPTION

Figure 1:
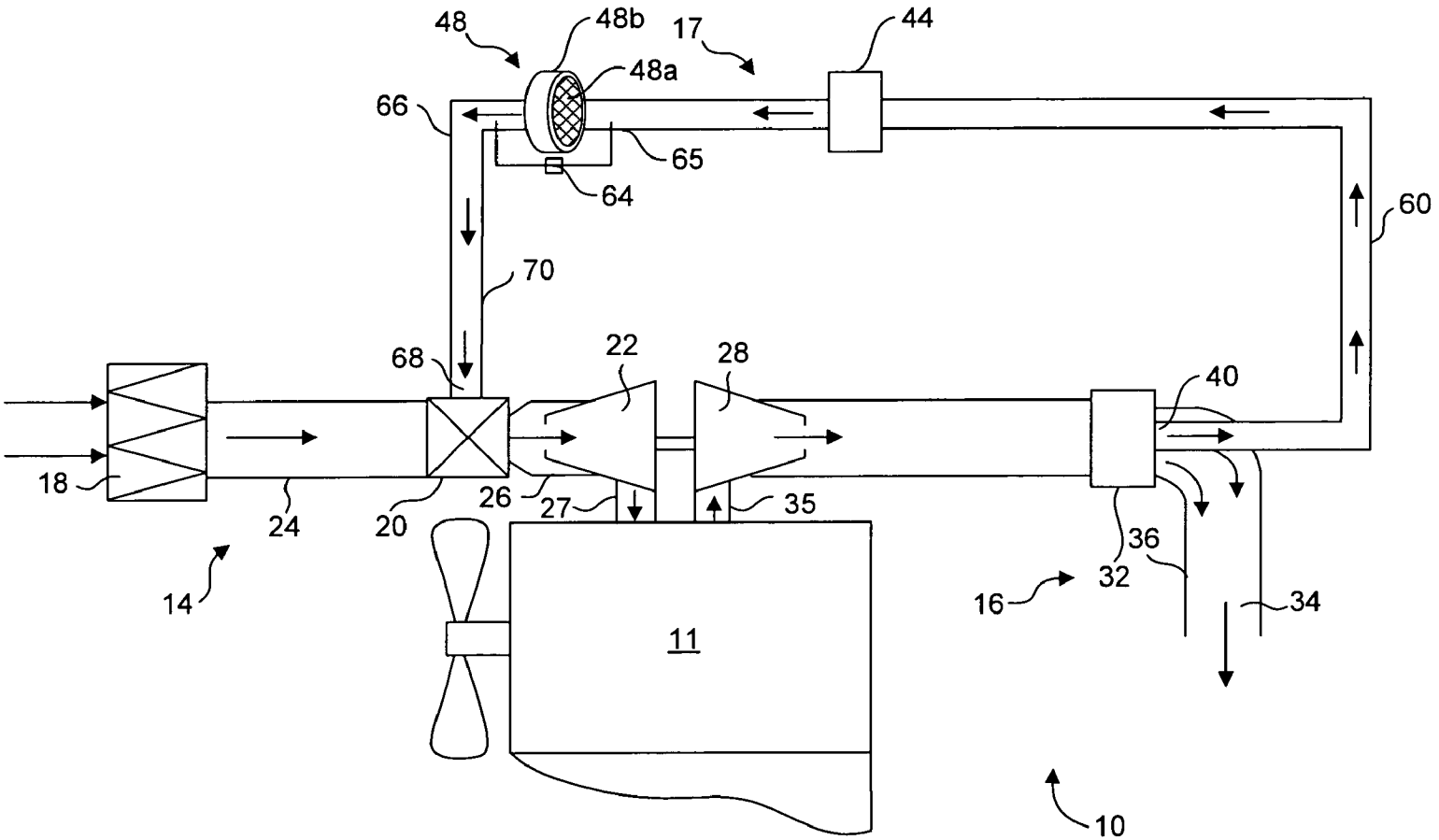
FIG. 1 is a diagrammatic illustration of an engine having an exhaust treatment system according to an exemplary disclosed embodiment.

FIG. 1 illustrates an exemplary power source 10. Power source 10 may include an engine 11 such as, for example, a diesel engine, a gasoline engine, a gaseous fuel-powered engine, or any other engine apparent to one skilled in the art. Power source 10 may, alternatively, include a non-engine source of power such as a furnace. Power source 10 may include an air induction system 14 that draws fresh air into engine 11, an exhaust system 16 that directs exhaust away from engine 11 and a recirculation system 17 that redirects a portion of the exhaust from exhaust system 16 back into air induction system 14.

Air induction system 14 may include components that cooperate to introduce cleaned and pressurized air into a combustion chamber (not shown) of engine 11. Specifically, air induction system 14 may include an air filter 18, an induction valve 20 and a compressor 22. Air may pass from filter 18 through induction valve 20 prior to entering engine 11. It is contemplated that additional components may be included within air induction system 14 such as, for example, one or more air coolers, additional valving, one or more waste gates, a control system, and other components known in the art.

Air filter 18 may remove or trap debris from air flowing into engine 11. Air filter 18 may include any type of air filter known in the art such as, for example, a full-flow filter, a self-cleaning filter, a centrifuge filter or an electro-static precipitator. It is contemplated that more than one air filter 18 may be included within air induction system 14 and disposed in series or parallel relation.

Induction valve 20 may regulate the flow of atmospheric air and recirculated exhaust gas to engine 11 and may be fluidly connected to air filter 18 via a fluid passageway 24 and to compressor 22 via a fluid passageway 26. Induction valve 20 may be a butterfly valve, a gate valve, a ball valve, a globe valve, or any other type of valve known in the art. Induction valve 20 may be solenoid actuated, hydraulically actuated, pneumatically actuated, or actuated in any suitable manner. Induction valve 20 may be in communication with a controller (not shown) and selectively actuated in response to one or more predetermined conditions.

Compressor 22 may compress the air flowing into engine 11 to a predetermined pressure. Compressor 22 may be fluidly connected to engine 11 via a fluid passageway 27. Compressor 22 may embody a fixed geometry type compressor, a variable geometry type compressor, or any other type of compressor known in the art that receives a flow of air and increases the pressure thereof. It is contemplated that more than one compressor 22 may be included and disposed in parallel or in series relation. It is further contemplated that compressor 22 may be omitted, when a non-pressurized air induction system is desired.

Exhaust system 16 may include components that direct and/or treat exhaust from engine 11. In particular, exhaust system 16 may include a turbine 28, a particulate filter 32 and an exhaust outlet 34. The exhaust from engine 11 may pass through turbine 28 and particulate filter 32 to exhaust outlet 34 before discharge to the atmosphere. It is contemplated that additional emission-controlling devices may be included within exhaust system 16, if desired.

Turbine 28 may be connected to engine 11 via a fluid passageway 35 and may drive compressor 22. In particular, as the hot exhaust gases exiting engine 11 expand against the blades (not shown) of turbine 28, turbine 28 may rotate and drive connected compressor 22. It is contemplated that more than one turbine 28 may be included within exhaust system 16 and disposed in parallel or in series relationship. It is also contemplated that turbine 28 may, alternatively, be omitted and compressor 22 may be driven as a supercharger by engine 11 mechanically, hydraulically, electrically, or in any other manner known in the art.

Particulate filter 32 may be placed downstream of turbine 28 to remove particulates from the exhaust and may include electrically conductive coarse mesh elements that have been sintered together under pressure. It is further contemplated that particulate filter 32 may, alternatively, include electrically non-conductive coarse mesh elements such as, for example, porous elements formed from a ceramic material or a high-temperature polymer. It is also contemplated that more than one particulate filter 32 may be included within exhaust system 16 and disposed in series or parallel relation.

Particulate filter 32 may include an oxidation catalyst (not shown) and a means for regenerating the particulate matter trapped by particulate filter 32 (not shown). The means for regeneration may include, among other things, a fuel-powered burner, an electrically resistive heater, an engine control strategy or any other means for regenerating known in the art. The oxidization catalyst may include, for example, a base metal oxide, a molten salt and/or a precious metal. In order to reduce the temperature required for regeneration of particulate filter 32, the catalyst may be used to increase the rate nitric oxide (NO) gases from the exhaust of engine 11 form nitrogen dioxide ($NO_2$). Nitrogen dioxide combusts soot at a lower temperature than oxygen and therefore enables regeneration to take place at lower temperatures and with less fuel. During the formation of nitrogen dioxide, the catalyst may also increase the rate at which sulfur dioxide ($SO_2$) within the exhaust gas oxidizes to form highly reactive sulfur trioxide ($SO_3$).

Exhaust outlet 34 may be located downstream of and fluidly connected to particulate filter 32 via a fluid passageway 36. Exhaust outlet 34 may direct exhaust flow from engine 11 to the atmosphere. It is contemplated that an attenuation device, selective catalytic reduction (SCR) device and/or other noise abatement and exhaust treatment devices may be associated with exhaust outlet 34, if desired.

Recirculation system 17 may include components that interact to treat and redirect a portion of the exhaust flow of engine 11 from exhaust system 16 into air induction system 14. That is, recirculation system 17 may include an inlet port 40, a cooler 44, an acidic debris filter 48 and a pressure sensor 64. It is contemplated that recirculation system 17 may include additional components such as, for example an electrostatic precipitator device, a shield gas passageway, valve mechanisms, a control system and other recirculation system components known in the art.

Inlet port 40 may be connected to exhaust system 16 at passageway 34 to receive at least a portion of the exhaust flow from engine 11. Inlet port 40 may be disposed downstream from one or more pressure reducing devices such as filter 32 and turbine 28, and upstream from acidic debris filter 48. In this configuration, recirculation system 17 may be a low-pressure system (i.e., the exhaust from exhaust system 16 may be drawn into an air induction system 14, as opposed to being forced into air induction system 14).

Cooler 44 may be fluidly connected to inlet port 40 via a fluid passageway 60 to cool the portion of the exhaust flowing through inlet port 40. Cooler 44 may include a liquid-to-air heat exchanger, an air-to-air heat exchanger or any other type of heat exchanger known in the art for cooling an exhaust flow. As exhaust gas passes though cooler 44, water vapor may condense and combine with $SO_3$ and $NO_2$ gases (generated within particulate filter 32) to form sulfuric acid ($H_2SO_4$) and nitric acid ($HNO_3$), respectively.

Acidic debris filter 48 may be fluidly connected downstream of cooler 44 via a passageway 65 and may contain an acid resistant filter media **48*a* housed within a metallic cage 48*b*. Metallic cage 48*b*, when exposed to the sulfuric and nitric acid may rapidly oxidize, forming voluminous precipitate. For example, metallic cage 48*b* may have been treated with zinc (Zn), so that, when exposed to $SO_3$ and $NO_2$, zinc sulfate ($ZnSO_4$) and zinc nitrate ($Zn(NO_3)_2$) precipitate and a variety of other oxides of nitrogen and sulfur may be formed, depending upon the concentration and temperature of the acids. In addition, metallic cage 48***b* may be fabricated from iron so that, when exposed to $SO_3$ and $NO_2$, iron sulfate ($Fe_2SO_4$) and iron nitrate ($FeNO_3$) may be formed, respectively. It is contemplated that metallic cage 48*b* may be fabricated from other metals that may react to neutralize acids formed within cooler 44, if desired.

Filter media 48*a* within acidic debris filter 48 may be dense enough to capture the solid precipitate formed by the oxidizing reaction between metallic cage 48*b* and exhaust acids. Furthermore, filter media 48*a* may have a filtering efficiency approaching that of particulate filter 32, such that under normal operating conditions, acidic debris filter 48 may capture few particulates that pass through particulate filter 32. However, in the event of a failure of particulate filter 32, acidic debris 48 may be dense enough to capture a substantial portion of the particulates passing through the damaged filter. It is further considered that filter media 48*a* may be impregnated with, or contain plies of, an acid sequestering material such as thermally expanded graphite or activated carbon. These materials may remove acid from the exhaust stream by absorption and sequestration.

Pressure sensor 64 may be placed in communication with fluid passageway 65 and 66 to measure a pressure drop across acidic debris filter 48. The measured pressure may then be compared with an expected pressure drop corresponding with a particular operating condition of engine 11, such as rotational speed. In this manner, pressure sensor 62 and acidic debris filter 48 may function together as a canary system, alerting an operator of power source 10 in the event of clogging in recirculation system 17, caused by either an unexpected amount of sulfuric and/or nitric acid or the failure of particulate filter 32. An unexpected amount of sulfuric or nitric acid may correspond with the improper use of a high sulfur content fuel.

Discharge port 68 may be fluidly connected to induction valve 20 via a fluid passageway 70 to direct the exhaust flow into air induction system 14. Specifically, discharge port 68 may be connected to air induction system 14 upstream of compressor 22, such that compressor 22 draws the exhaust flow from discharge port 68.

INDUSTRIAL APPLICABILITY

The disclosed exhaust treatment system may be applicable to any combustion-type device such as, for example, an engine or a furnace where the recirculation of reduced-particulate gas into an air induction system is desired. The disclosed acidic debris filter of the exhaust treatment system may be a simple, effective solution to removing acid that forms during the exhaust recirculation process. The disclosed acidic debris filter may also function as a backup filter, useful in the event of a primary particulate filter failure. With this configuration, the disclosed exhaust treatment system may reduce the amount of exhaust emissions discharged to the environment, while protecting the combustion-type device from harmful particulates and corrosives. In addition, the disclosed exhaust treatment system may provide a warning that improper fuel has been used or that the primary particulate filter has failed. Operation of the exhaust treatment system will now be explained.

Atmospheric air may be drawn into air induction system 14 via induction valve 20 to compressor 22, where it may be pressurized to a predetermined level before entering the combustion chamber of engine 11. Fuel may be mixed with the pressurized air before or after entering the combustion chamber. Generally, the fuel used in the combustion chamber may have a sulfur content of less than about 15 parts per million (ppm). But, in some instances, the fuel may have a greater sulfur content. This fuel-air mixture may be combusted by engine 11 to produce mechanical work and an exhaust flow containing gaseous compounds and solid particulate matter. The exhaust flow may be directed via fluid passageway 35 to one or more downstream components, such as turbine 28 and particulate filter 32. The expansion of the hot exhaust gasses may cause turbine 30 to rotate, thereby rotating compressor 22 and compressing the inlet air.

After exiting turbine 30, the exhaust gas flow may be directed to particulate filter 32 where particulate matter entrained with the exhaust flow may be filtered. The particulate matter, when deposited on the coarse mesh elements of particulate filter 32 may be passively and/or actively regenerated in a conventional manner. During regeneration, excess sulfur dioxide and nitric oxide in the exhaust gas may react with the catalyst of particulate filter 32 to form $SO_3$ and $NO_2$ ions, respectively. As exhaust gas exits particulate filter 32, the exhaust gas may be divided into two flows, a first flow redirected to recirculation system 17 and a second flow directed to exhaust outlet 34. The exhaust directed toward recirculation system 17 may flow through inlet port 40 to cooler 44, where it may be cooled to a predetermined temperature.

Rapid cooling within cooler 44 may cause water vapor ($H_2O$) within the exhaust gas mixture to condense on the walls of the cooler. The $SO_3$ and $NO_2$ compounds formed during regeneration of particulate filter 32 may react with the condensed water to form sulfuric and nitric acid, respectively. These acids formed in cooler 44, if circulated through the downstream components of recirculation system 17 and into engine 11, may rapidly corrode those components and may shorten engine life. The risk of acid formation and subsequent corrosion may be dramatically increased with the use of fuel that has a sulfur content greater than 15 ppm.

Metallic cage 48*b* of acidic debris filter 48 may neutralize the sulfuric and nitric acids formed within cooler 44. For example, metallic cage 48*b* may be formed of a galvanized (zinc dipped or plated) steel mesh, and the sulfuric and nitric acid may oxidize the galvanized metal to form large particulates of sulfate, nitrate and mixed oxide corrosion debris, including: $FeSO_4$, $ZnSO_4$, $FeNO_3$, $Zn(NO_3)_2$, nitrites, oxides and other reaction products, contained by the filtration media 48*a* of acidic debris filter 48. Under normal operating conditions, particulate filter 32 may entrap substantially all particulates upstream of cooler 44. However, in the event of failure of particulate filter 32, acidic debris filter 48 may capture many of the particulates normally trapped by particulate filter 32. It is further contemplated that filter media 48*a* may contain an acid sequestering material, for example thermally expanded graphite or activated carbon, that may contribute to the filtration of acid from the exhaust flow.

Pressure sensor 64 may measure the pressure drop across acidic debris filter 48 for comparison to an expected value corresponding to an engine operating parameter. For example, the expected pressure loss corresponding to an idle engine state may be about 3 kPa and a pressure loss exceeding a predetermined threshold, for example 5 kPa, may indicate clogging in acidic debris filter 48. A fault may be reported to the operator when the pressure loss exceeds the predetermined value. The fault may indicate that acidic debris filter has been clogged, either due to improper sulfur content fuel or due to a failure of particulate filter 32.

After passing through pressure sensor 64, the neutralized exhaust gas may be directed to induction valve 20, where it may be drawn back into air induction system 14 by compressor 22. The recirculated exhaust flow may then be mixed with the air entering the combustion chamber of engine 11. The exhaust gas, which is directed to the combustion chamber, reduces the concentration of oxygen therein, which in turn lowers the combustion temperature within the cylinder. The lowered combustion temperature slows the chemical reaction of the combustion process, thereby decreasing the formation of nitrogen oxides. In this manner, the gaseous pollution produced by power source 10 may be reduced without experiencing the harmful effects and poor performance caused by excessive particulate matter being directed into power source 10.

Several advantages may be associated with the exhaust system of the present disclosure. Specifically, the disclosed system may allow for the neutralization of acids introduced during the recirculation of exhaust gases. Furthermore, the exhaust system of the present disclosure may provide a warning when clogging occurs within the recirculation system, indicating a possible misfueling event or damage to a primary particulate filter. In addition, in the event of a failure of a primary filter, the disclosed system may provide backup protection limiting the recirculation of harmful particulates. The advantages of the present disclosure may mitigate the risk of recirculating damaging particulates and corrosives into an engine during exhaust gas recirculation and provide a greater degree of reliability to power source 10, while reducing the emission of nitrogen oxides.

It will be apparent to those skilled in the art that various modifications and variations can be made to the disclosed exhaust treatment system. Other embodiments will be apparent to those skilled in the art from consideration of the specification and practice of the disclosed exhaust treatment system. It is intended that the specification and examples be considered as exemplary only, with a true scope being indicated by the following claims and their equivalents.

What is claimed is:

1. An exhaust treatment system for a power source, comprising:

an air induction system;

an exhaust system, including a particulate filter; and a recirculation system configured to draw exhaust from the exhaust system at a location downstream of the particulate filter and to direct the exhaust to the air induction system, the recirculation system including:

an exhaust gas cooler; and an acidic debris filter located downstream of the exhaust gas cooler, the acidic debris filter being provided in a metallic housing that, when exposed to acid, reacts to neutralize the acid and form a solid precipitate.

2. The exhaust treatment system of claim 1, wherein the acidic debris filter includes a media resistant to acid.

3. The exhaust treatment system of claim 1, wherein the metallic housing is a cage fabricated from galvanized steel.

4. The exhaust treatment system of claim 1, wherein the acidic debris filter media has a particulate trapping efficiency great enough to capture the solid precipitate formed by the reaction of acid with the metallic cage, but less than that of the particulate filter.

5. The exhaust treatment system of claim 1, wherein the acid is sulfuric acid.

6. The exhaust treatment system of claim 1, wherein the recirculation system further includes a pressure sensor configured to measure a pressure drop across the acidic debris filter.

7. The exhaust treatment system of claim 6, wherein the pressure drop across the acidic debris filter is compared with an expected pressure drop corresponding to an engine operating characteristic to determine a misfueling event.

8. The exhaust treatment system of claim 1, wherein the media is configured to sequester acid.

9. The exhaust treatment system of claim 8, wherein the media includes at least one of thermally expanded graphite and activated carbon.

10. A power source, comprising:

an engine;

an air induction system configured to direct air into the engine;

an exhaust system configured to direct exhaust away from the engine and including a particulate filter;

a recirculation system configured to draw exhaust from the exhaust system at a location downstream of the particulate filter and to direct the exhaust into the air induction system, the recirculation system including:

an exhaust gas cooler; and an acidic debris filter located downstream of the exhaust gas cooler and fabricated with an acid resistant filter media supported by a metallic cage that, when exposed to acid, reacts to neutralize acid and form a solid precipitate.

11. The power source of claim 10, wherein the metallic cage is fabricated from galvanized steel.

12. The power source of claim 10, wherein the acidic debris filter media has a particulate trapping efficiency great enough to capture the solid precipitate formed by the reaction of acid with the metallic cage, but less than that of the particulate filter.

13. The power source of claim 10, wherein the recirculation system further includes a pressure sensor configured to measure a pressure drop across the acidic debris filter for comparison with an expected pressure drop corresponding to an engine operating characteristic.

14. The power source method of claim 10, wherein the acid is sulfuric acid.

15. A method of operating an exhaust treatment system for a power source, the method comprising:

directing air into the power source;

directing exhaust away from the power source;

reducing the amount of particulates in the exhaust;

cooling the particulate reduced exhaust; and removing acidic precipitate formed during the cooling, the removing of the acidic precipitate including oxidizing galvanized steel.

16. The method of claim 15, wherein the removing of acidic precipitate includes removing sulfuric acid.

17. The method of claim 15, further including:

sensing a pressure of the exhaust;

comparing the sensed pressure with an expected value; and recording a fault when the sensed pressure exceeds the expected value.

18. The method of claim 17, wherein an excessive difference between the sensed pressure and the expected value is interpreted as a misfueling event.

* * * * *